US006763766B1

(12) United States Patent
Cornellier

(10) Patent No.: US 6,763,766 B1
(45) Date of Patent: Jul. 20, 2004

(54) ELEVATED TRANSPORTATION SYSTEM

(76) Inventor: Maurice H. Cornellier, 7611 E. Broyhill Plate, Inverness, FL (US) 34450

( * ) Notice: Subject to any disclaimer, the term of this patent is extended or adjusted under 35 U.S.C. 154(b) by 0 days.

(21) Appl. No.: 10/226,957

(22) Filed: Aug. 23, 2002

(51) Int. Cl.[7] ..... B61K 1/00

(52) U.S. Cl. ..... 104/20; 104/18; 104/124; 105/1.1

(58) Field of Search ..... 104/18, 20, 124, 104/123, 125, 88.03, 88.02, 88.04, 27, 28; 105/453, 1.1, 1.2, 1.5

(56) References Cited

U.S. PATENT DOCUMENTS 1,648,505 A * 11/1927 Persu ..... 296/185
2,976,820 A * 3/1961 Schaar ..... 105/141
3,552,321 A * 1/1971 Priebe ..... 104/18
3,707,928 A * 1/1973 Germer ..... 105/210
3,823,671 A * 7/1974 Straumsnes ..... 104/18
4,018,410 A * 4/1977 Renaux ..... 705/8
6,038,980 A * 3/2000 Bittar et al. ..... 104/20
6,389,982 B1 * 5/2002 Evensen ..... 104/124
2001/0042488 A1 * 11/2001 Randak ..... 104/27
2002/0162478 A1 * 11/2002 Henderson ..... 104/124

* cited by examiner

*Primary Examiner*—Mark T. Le
(74) *Attorney, Agent, or Firm*—Edward P. Dutkiewicz

(57) ABSTRACT

A transportation system with a plurality of transportation subsystems, each having a plurality of units with a tear drop shape. A plurality of wheels extends from both sides of the units. At least one primary linear transportation subsystem support with an associated primary transportation subsystem includes a pair of C-shaped retention supports adapted to receive and retain the wheels. At least one secondary transportation subsystem support in the form of a loop and associated with a secondary transportation subsystem. The secondary transportation subsystem support loop is placed adjacent to the primary linear transportation subsystem support to facilitate the transfer of passengers and baggage between primary and secondary transportation subsystems.

3 Claims, 5 Drawing Sheets

FIG 1A
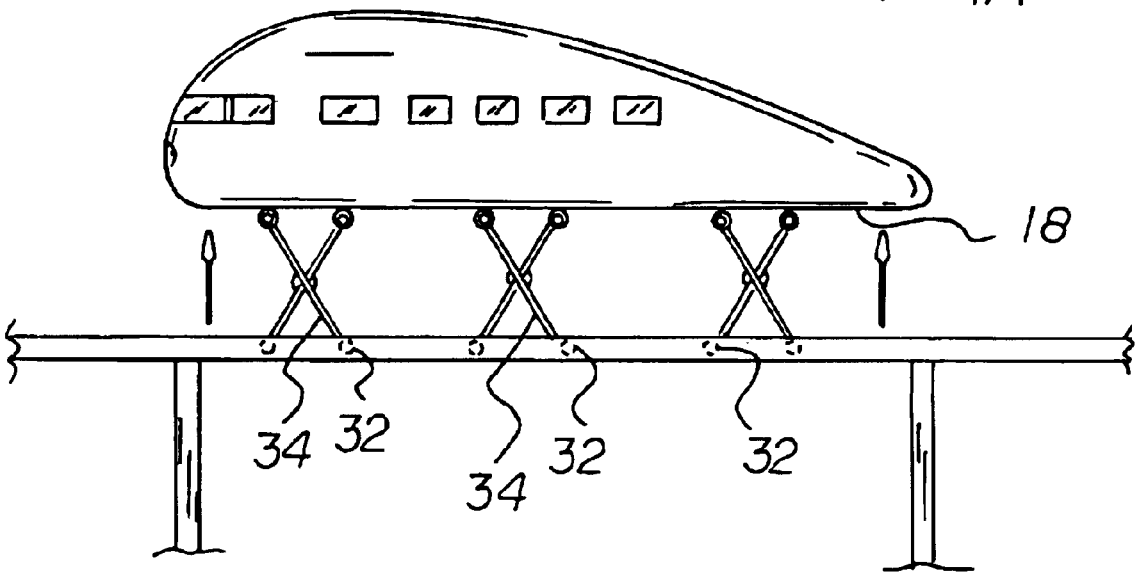
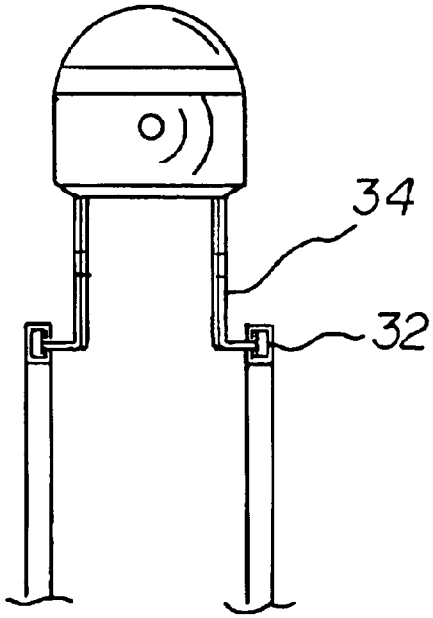
FIG 2A

FIG 3
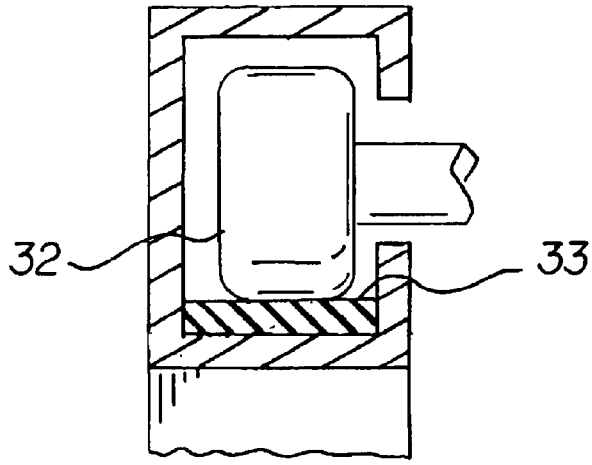
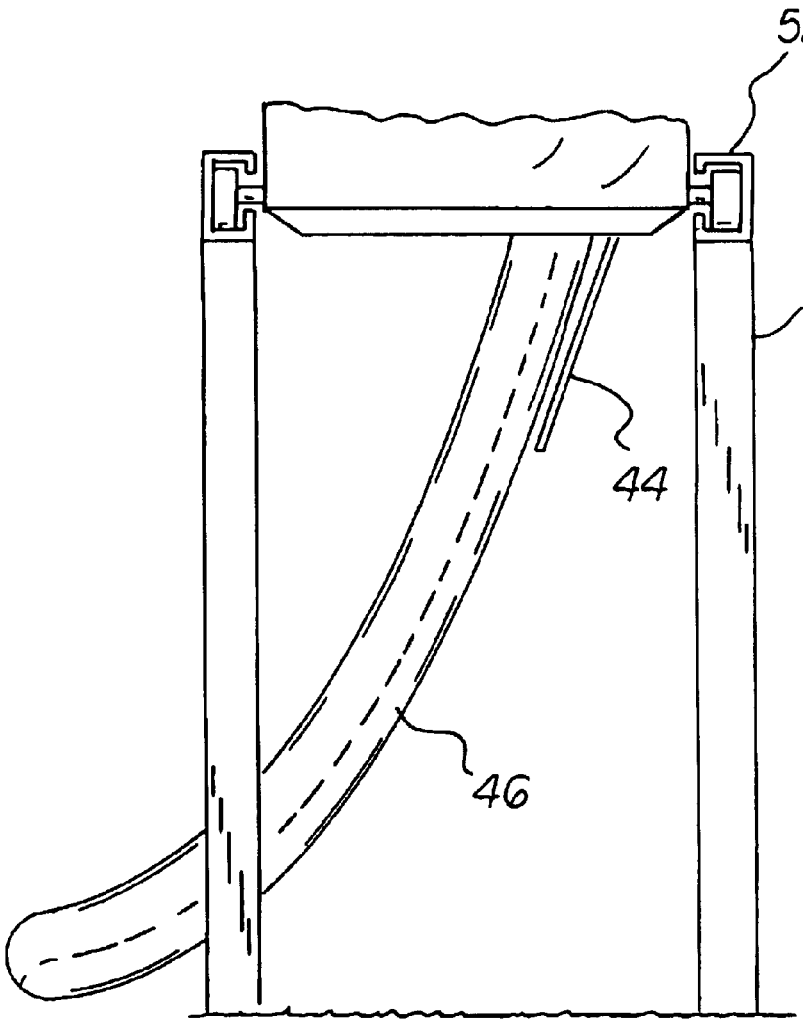
FIG 4

FIG 6
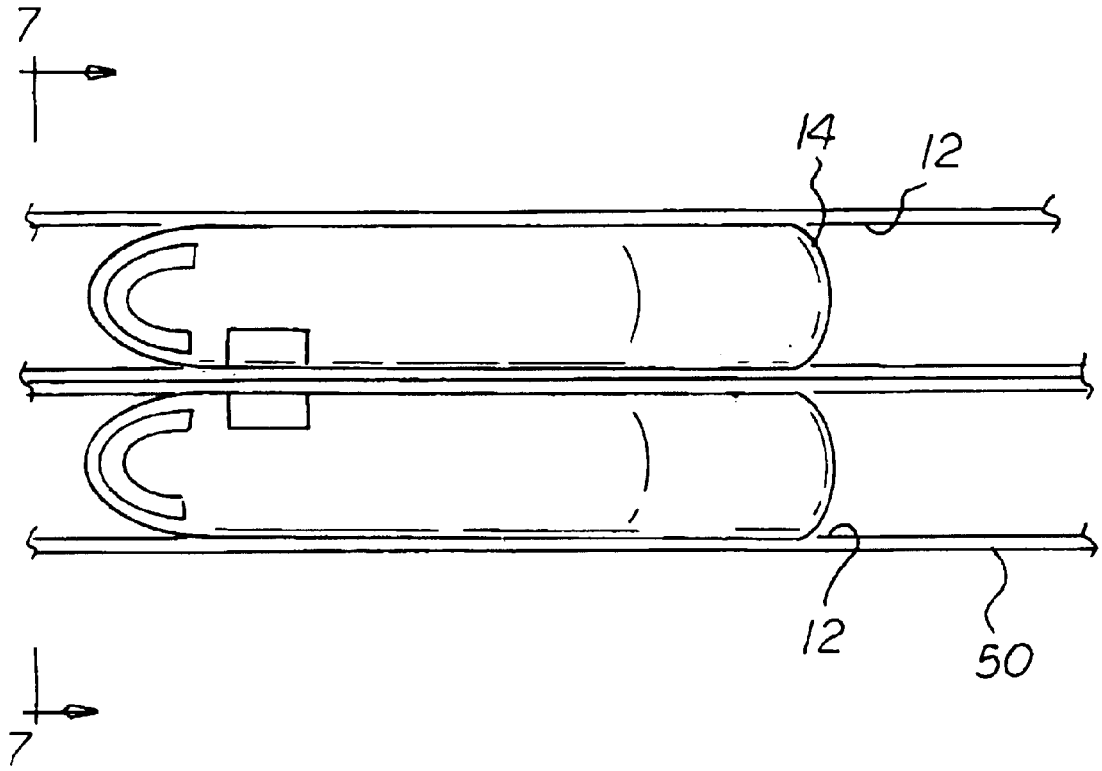
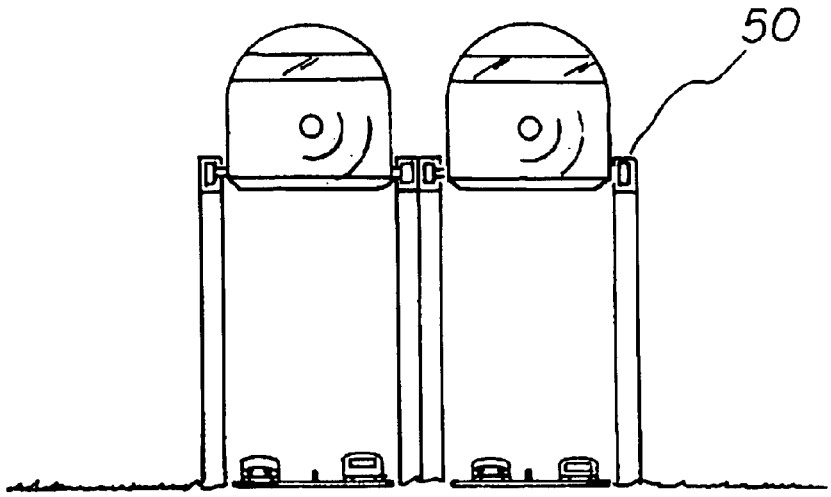
FIG 7

ELEVATED TRANSPORTATION SYSTEM

BACKGROUND OF THE INVENTION

1. Field of the Invention

The present invention relates to an elevated transportation system and more particularly pertains to expediting long distance travel.

2. Description of the Prior Art

The use of transportation systems of known designs and configurations is known in the prior art. More specifically, transportation systems of known designs and configurations previously devised and utilized for the purpose of improving travel through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,161,105 to Strauss discloses a rapid transit system. U.S. Pat. No. 3,211,110 to Pierson discloses roadway structures. Lastly, U.S. Pat. No. 5,456,183 to Geldbaugh discloses an integrated infrastructure transit system.

While these devices fulfill their respective, particular objectives and requirements, the aforementioned patents do not describe an elevated transportation system that allows expediting long distance travel.

In this respect, the elevated transportation system according to the present invention substantially departs from the conventional concepts and designs of the prior art, and in doing so provides an apparatus primarily developed for the purpose of expediting long distance travel.

Therefore, it can be appreciated that there exists a continuing need for a new and improved elevated transportation system which can be used for expediting long distance travel. In this regard, the present invention substantially fulfills this need.

SUMMARY OF THE INVENTION

In view of the foregoing disadvantages inherent in the known types of transportation systems of known designs and configurations now present in the prior art, the present invention provides an improved elevated transportation system. As such, the general purpose of the present invention, which will be described subsequently in greater detail, is to provide a new and improved elevated transportation system and method which has all the advantages of the prior art and none of the disadvantages.

To attain this, the present invention essentially comprises a transportation system including at least one primary transportation subsystems and at least one secondary transportation subsystems. Each transportation subsystem comprises a plurality of units. Each unit has an aerodynamic shape including a curved, cone-shaped front, a rearwardly angled, tapered top and a flat bottom and opposed lateral sides. A door and windows are provided in each side. A plurality of wheels are provided. The wheels extend from both sides of the units. A plurality of scissor acting suspension mechanism are next provided. This enables the units to elevate when the transportation system is at high speed. An escape door is provided in the bottom of each unit. Each escape door has an associated exit means including a chute, ladder or slide. Next provided is at least one primary linear transportation subsystem support with the associated primary transportation subsystem. The primary support includes a pair of C-shaped retention supports adapted to receive and retain the wheels of the unit during travel. The primary support is significantly elevated from the ground below by a plurality of riser beams. The primary support is linear over the majority of its extent to ensure maximum velocity without having to slow for turns and passenger pick up. At least one secondary transportation subsystem support loop associated with the secondary transportation subsystem is provided. The secondary supports are placed along the primary linear transportation subsystem support. The secondary transportation subsystem support loops have the shape of an obtuse isosceles triangle with rounded vertices such that the long base end is parallel with the primary transportation subsystem support. This configuration allows the secondary transportation subsystem to gain and maintain the speed of the primary transportation subsystem to facilitate the transfer of passengers and baggage between primary and secondary transportation subsystems.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved elevated transportation system which has all of the advantages of the prior art transportation systems of known designs and configurations and none of the disadvantages.

It is another object of the present invention to provide a new and improved elevated transportation system which may be easily and efficiently manufactured and marketed.

It is further an object of the present invention to provide a new and improved elevated transportation system which is of durable and reliable constructions.

An even further object of the present invention is to provide a new and improved elevated transportation system which is susceptible of a low cost of manufacture with regard to both materials and labor, and which accordingly is then susceptible of low prices of sale to the consuming public, thereby making such elevated transportation system economically available to the buying public.

Even still another object of the present invention is to provide an elevated transportation system for expediting long distance travel.

Lastly, it is an object of the present invention to provide a new and improved transportation system including a plurality of transportation subsystems. Each transportation subsystem comprising of a plurality of units. A plurality of wheels extends from both sides of the units. A plurality of scissor acting suspension mechanism extending from the bottom of the units to the associated wheels to allow lift of the units. At least one primary linear transportation subsystem includes a pair of C-shaped retention supports adapted to receive and retain the wheels of the transportation system during travel. At least one secondary transportation subsystem is in the form of a loop. The secondary transportation subsystem support is placed along the primary linear transportation subsystem support to facilitate the transfer of passengers and baggage between primary and secondary transportation subsystems.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1A is a side elevational view of a unit of the transportation system in its elevated state constructed in accordance with the principles of the present invention and also illustrating lanes of traffic.

FIG. 2A is a front elevational view of a unit of the transportation system in its elevated state taken along line 2—2 of FIG. 1.

FIG. 3 is an enlarged cross-sectional view of the wheel and support combination taken from circle 3 of FIG. 2.

FIG. 4 is an end view of the escape door and exit means constructed in accordance with the principles of the present invention.

FIG. 6 is a plan view of a transportation subsystem on the primary support coupled to a transportation subsystem on the secondary support taken along line 6—6 of FIG. 5.

FIG. 7 is a front elevational view of coupled transportation systems taken along line 7—7 of FIG. 6.

The same reference numerals refer to the same parts throughout the various Figures.

DESCRIPTION OF THE PREFERRED EMBODIMENT

Figure 1:
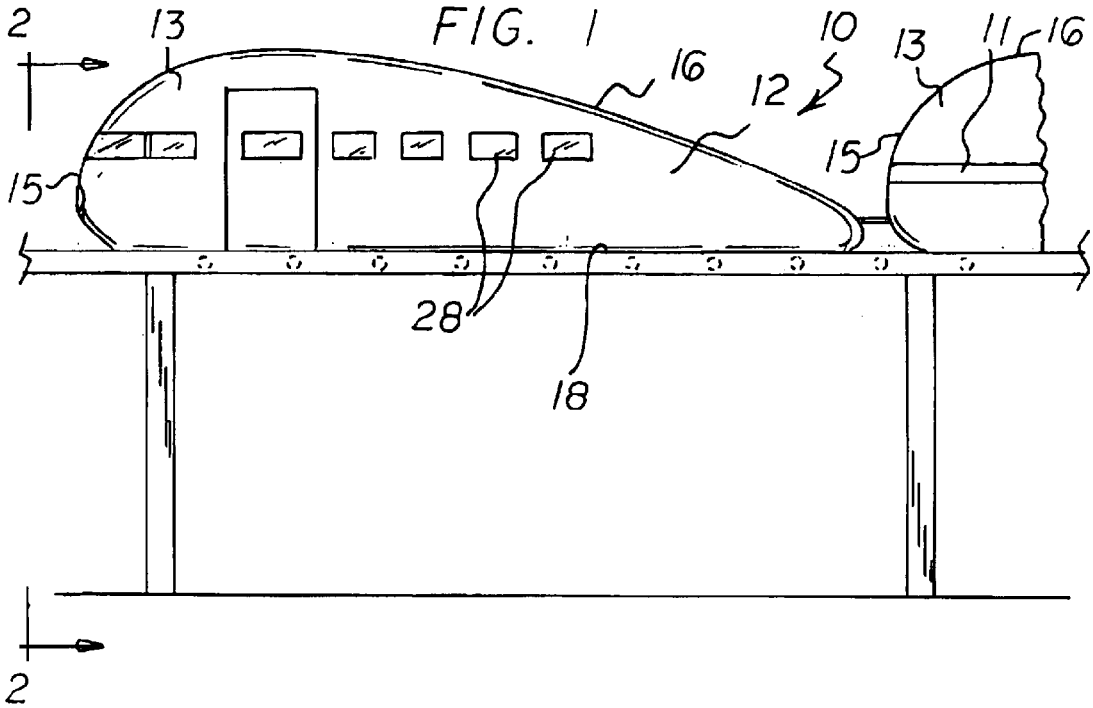
FIG. 1 is a side elevational view of a unit of the transportation system in its lowered state constructed in accordance with the principles of the present invention.
Figure 2:
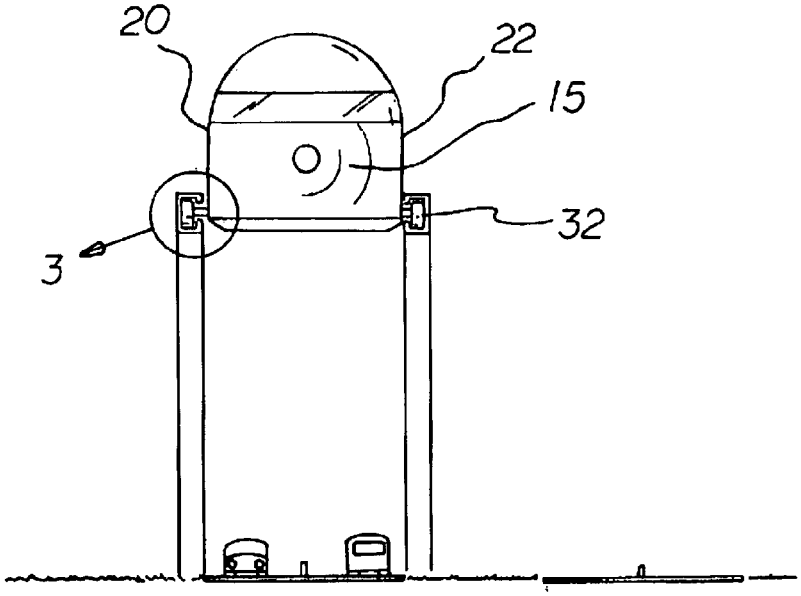
FIG. 2 is a front elevational view of a unit of the transportation system in its lowered state taken along line 2—2 of FIG. 1.
Figure 5:
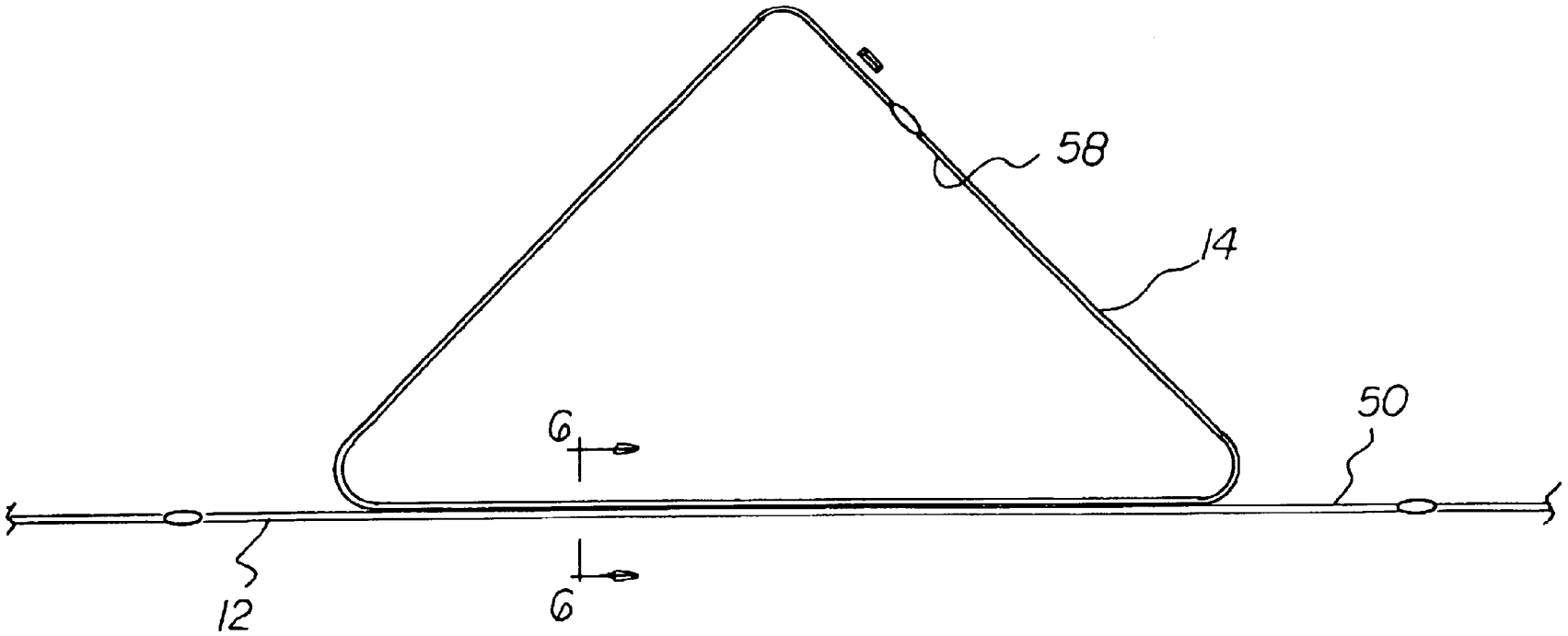
FIG. 5 is a schematic illustration of the association of the primary linear support and the secondary supports in loops.

With reference now to the drawings, and in particular to FIG. 1 thereof, the preferred embodiment of the new and improved elevated transportation system embodying the principles and concepts of the present invention and generally designated by the reference numeral 10 will be described.

The present invention, the elevated transportation system 10 is comprised of a plurality of components. Such components in their broadest context include a plurality of units, a plurality of wheels, at least one linear transportation subsystem support and at least one secondary transportation subsystem support in a loop. Such components are individually configured and correlated with respect to each other so as to attain the desired objective.

First provided is a plurality of transportation subsystems 12, 14 each with a plurality of units 13. Such units are adapted to hold either passengers or luggage. Furthermore the units being are constructed with horizontal dividers 11 giving the units more than one level. Such units are further able to be spaced out from the next nearest unit. The transportation systems include at least one primary transportation subsystem 12 and at least one secondary transportation subsystem 14. Each transportation system has compartments or units with an aerodynamic shape with a tubular body including a curved, cone-shaped front 15, a rearwardly tapered, angled top 16 and a flat bottom 18 and opposed lateral sides 20, 22. A door 26 and windows 28 are provided in each side.

A plurality of wheels 32 are provided. The wheels extend from both sides of the units. The wheels rest in rolling contact upon continuous rails 33, preferably fabricated of a wear resistant material such as high carbon steel. Between the bottom 18 of the transportation systems and the wheels are a plurality of scissor acting suspension mechanisms 34. Such mechanisms are adapted to allow the transportation system to elevate from its wheels when at high speed due to the shape of the units and lower when it slows down. This reduces the drag and resistance of the transportation systems.

An escape door 44 is provided in the bottom of each unit. Each escape door has an associated exit means 46 such exit mean including but not limited to a chute, ladder, slide or boat.

Next provided is at least one primary linear transportation subsystem support 50 with an associated primary transportation subsystem. The primary support includes a pair of C-shaped retention supports 52 with rails 33 adapted to receive and retain the wheels of the transportation subsystems during travel. The primary linear support is significantly elevated from the ground below by a plurality of riser beams 54. The primary support is linear over the majority of its extent to ensure maximum velocity without having to slow for turns and passengers.

The path of travel of the unit conveying the passengers and cargo is preferably over cars and trucks traveling a highway system. It should be understood, however, that the path of travel could be otherwise, including paths of travel above existing or future conventional trains.

At least one secondary transportation subsystem support in a loop 58 with associated secondary transportation subsystems is provided. The secondary transportation subsystem support in a loop is placed along the primary linear transportation subsystem support. The secondary transportation subsystem support loops have the shape of an obtuse isosceles triangle with rounded vertices such that the long base end is parallel with the primary transportation subsystem support. This configuration allows the secondary transportation subsystem to gain and maintain the speed of the primary unit to facilitate the transfer of passengers and baggage between primary and secondary transportation subsystems. The pair of supports being adapted to fit over a two lane road and the associated road side.

There are presently three major public overland transportation systems that are responsible for moving large numbers of people. They are the airlines, trains and buses. The efficient operation of these three present travel systems depends on five very important factors: 1) the physical fitness of the individual operating the equipment; 2) the operator's experience and ability; 3) the condition of the equipment; 4) traffic density; and 5) the effect of the prevailing weather conditions, such as fog, heavy snow storms, icy road conditions, flooding, and road washout, etc. While it is possible to control four of the above-mentioned conditions, number 5) is about the weather. There is little we can do but accept it. However, there is a novel way that could be implemented to overcome the last condition which would allow the movement of large numbers of people safely in all weather conditions. Some of the weather conditions that seriously affect travel and create hazardous traveling are heavy snowfall, flooding, fog, and rain causing sleet, washouts, etc.

The current Interstate Highway System and also the major state express highways offer a suitable base for the installation of a high speed overhead people and freight moving system. The proposed transportation system could and would operate safely in any weather condition mentioned. Actually, this new public transportation proposal system would, or could, obsolete all current "continental" airplane travel and all other commercial means of surface travel mentioned above.

The new proposed safe all-weather travel system could be achieved by installing steel upright support units imbedded in a solid concrete base. The upright-supporting units would be located and spaced along the right and left side shoulders of the road and parallel to the road. The upright steel beams would be solidly implanted in a reinforced concrete base. Upon these upright steel standards, located on each side of the road, would serve to support the placement of a horizontal "C" steel beam. These horizontal seel beams located along the left and right side of the highway, would each serve to encase a multi-wheel carriage unit. To these encased carriage units opposite of each other would serve to support between them an extended horizontal steel beam. This horizontal unit, attached at each end to the left and right multi-wheel carriages, would be able to travel freely above the highway below. The traffic of vehicle moving below would not be affected in any way by this new installation, since it would be located high above the surface of the roadway. See the Figures for reference and clarification.

The horizontal beams would then serve as the supporting base for the passenger seating units and also for the lower level cargo and freight storage area. The passenger units would be designed to provide all amenities for passenger comfort and tastes.

It is intended that this new and particularly safe mode of travel will be able to reach a very high safe speed, to compete with airplane travel as much as it is possible without creating any peril to the passengers or damage to any delicate packages. For maximum safety when traveling at high speed, a television/scanning monitoring unit system, located well ahead of the main passenger and at a safe distance, would serve as a warning system in the event of any possible emergency. Assuming the worst possible situation that could occur and it became necessary to abandon or abort a trip, it would be a simple matter to open the bottom emergency hatch and deploy the flexible escape chutes, allowing the passengers to slide down, perhaps 30 feet, to safety to the highway below. In an alternative embodiment the entire unit could be lower to the ground level.

It is conceivable that a narrower passenger-like facility could be installed parallel and to the right of the unit described above, to accommodate local travel. Further it would allow transfer of passengers to the main high speed service, without having the main unit stop for pick-up or unloading of more passengers.

The accommodation for passengers and the freight units could be separated for added safety, to avoid dangerous situations such as hi-jacking which could occur. The two units could be in tandem, but separated by a connecting corridor-like unit extending from the rear of the front passenger unit to the rear separate baggage unit. This could prevent sabotage in the passenger unit area.

The new method of transportation proposed in this invention will incorporate the same principle of the present airplane wing design. The leading edge of the "Davis Wing" design is contoured so that the leading edge causes air turbulence above the wind and reduces the air pressure on the top of the wing. The relative low turbulent air pressure difference above the wing as compared with the stable wind pressure on the underside is what causes the plane to have lift and is airborne, thus reducing somewhat the load pressure on the carriages on the two parallel "C" beam supports.

The novel transportation system incorporates the principle noted above, but operates above and over the present Federal interstate and State highway systems. This new system could operate safely regardless of severe weather conditions such as heavy snowstorm, deep snow accumulation, fog or poor visibility, flooding, road washout etc. In addition, it would offer more convenience since the terminals would be located in or near the city limits, avoiding parking fees, etc.

The horizontal steel beams extending above and across and spanning the highway below will serve to support the passenger and freight units. The ends will be connected to multi-wheel carriages enclosed in parallel steel supports, on each side of the road shoulder. The supporting carriages could be attached to steel multi-wheels that would travel freely within the cavity of the "C" steel beam. Another suggestions for the movement of the supporting carriage, is that the "C" beam could enclose rollers and these would support a long sled like shape unit to ride easily with little friction. For braking purposes, to stop travel of the passenger/freight unit, the upper inner interior of the "C" steel beam could be used. This would be in addition to the use of wind airfoils for braking.

Power may be provided to the units of each subsystem by any of a plurality of techniques. Such techniques include engines such as used in jet aircrafts, electricity provided through a third rail as used in subways, solar sources, etc.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An elevated transportation system adapted to expedite long distance travel comprising, in combination:

a plurality of subsystems including at least one primary subsystem and at least one secondary subsystem, each subsystem having at least one unit with an aerodynamic shape with a tubular body including a curved, cone-shaped front, a rearwardly angled, tapered top and a flat bottom and opposed lateral sides with a door and windows in each side a plurality of wheels extending from both sides of the units, with a plurality scissor acting suspension mechanisms between the wheels and the flat unit bottom allowing the transportation subsystems to elevate when at high speeds and lower during decelerations;

an escape door in the bottom of each unit with an associated exit means at least one primary linear transportation subsystem support for an associated primary transportation subsystem, the primary support including a pair of C-shaped retention support adapted to receive and retain the wheels of the transportation subsystems during travel and the primary linear support being significantly elevated from the ground below by a plurality of riser beams, the primary support being linear over the majority of its extent to ensure maximum velocity without having to slow for turns;

at least one secondary transportation subsystem support in the form of a loop for an associated secondary transportation subsystem, the secondary transportation subsystem support loop being placed along the primary linear transportation subsystem support, the secondary transportation subsystem support loop having the shape of an obtuse isosceles triangle with rounded vertices such that the long base end is parallel with the primary transportation subsystem support allowing the secondary transportation subsystem to gain and maintain the speed of the primary transportation subsystem to facilitate the transfer of passengers and baggage between primary and secondary transportation subsystems.

2. A transportation subsystem comprising:

a transportation system including at least one primary transportation subsystem and a secondary transportation subsystem, each said subsystem including at least one unit having a tear drop shape, the unit of the primary transportation subsystem being dedicated solely to the primary transportation subsystem and the unit of the secondary transportation subsystem being dedicated solely to the secondary transportation subsystem;

a plurality of wheels extending from both sides of each unit;

at least one primary linear transportation subsystem support, the linear transportation subsystem support including a pair of C-shaped retention supports adapted to receive and retain the wheels of the transportation subsystems during travel; and at least one secondary transportation subsystem support in the form of a loop, the secondary transportation subsystem loop being placed along the primary linear transportation subsystem support to facilitate the transfer of passengers and baggage between primary and secondary transportation subsystems.

3. The transportation subsystem as set forth in claim 2 and further including a plurality of scissor acting suspension mechanisms between the unit and the wheels.

* * * * *